United States Patent [19]

Hayashi

[11] Patent Number: 4,730,755

[45] Date of Patent: Mar. 15, 1988

[54] AUTOMATIC POURING FURNACE

[75] Inventor: Shizuo Hayashi, Suzuka, Japan

[73] Assignee: Fuji Electric Co., Ltd., Kawasaki, Japan

[21] Appl. No.: 501,158

[22] Filed: Jun. 6, 1983

[30] Foreign Application Priority Data

Jun. 5, 1982 [JP] Japan ..... 57-96803

[51] Int. Cl.[4] ..... B22D 39/06

[52] U.S. Cl. ..... 222/595; 222/590; 222/61

[58] Field of Search ..... 222/590, 594, 595, 603, 222/52, 61, 63, 64, 129.4, 54; 364/468, 472, 476

[56] References Cited

U.S. PATENT DOCUMENTS

| | | | |
|---|---|---|---|
| 3,412,899 | 11/1968 | Sutter | 222/595 |
| 3,486,660 | 12/1969 | Heintz | 222/54 X |
| 3,620,294 | 11/1971 | Hetzel | 164/155 |
| 3,998,365 | 12/1976 | Lethen et al. | 222/595 X |
| 4,202,387 | 5/1980 | Upton | 222/54 X |
| 4,252,253 | 2/1981 | Shannon | 222/129.4 X |
| 4,265,371 | 5/1981 | Desai et al. | 222/129.4 X |
| 4,276,999 | 7/1981 | Reichenberger | 222/129.4 |
| 4,316,532 | 2/1982 | Levasseur | 194/1 N |

FOREIGN PATENT DOCUMENTS

| | | | |
|---|---|---|---|
| 2460170 | 1/1981 | France | 165/155 |

*Primary Examiner*—Joseph J. Rolla
*Assistant Examiner*—Michael S. Huppert
*Attorney, Agent, or Firm*—Brumbaugh, Graves, Donohue & Raymond

[57] ABSTRACT

The invention relates to a control apparatus for an automatic pouring furnace. According to the invention, the control apparatus, for example, a microcomputer, reads from a memory to regulate shot pressure and time periods for application of the shot pressure to effect a pouring operation as a function of the particular mold to be filled. Thus, a single furnace can be regulated automatically to fill a plurality of molds which, while limited in number, are various in kind.

9 Claims, 12 Drawing Figures

AIR CONTROL CIRCUIT FLOW DIAGRAM

AUTOMATIC POURING FURNACE

BACKGROUND OF THE INVENTION

This invention relates to an automatic pouring furnace, and more particularly, to a control apparatus for a pouring furnace which reads from a memory and automatically adjusts pressure and time variables for a pouring operation as a function of the particular mold to be filled in the pouring operation.

In automatic pouring furnaces, metal or other material is melted by means of induction heating. The molten metal is stored within a reservoir and urged under a base pressure through a throat into a pouring chamber up to a preset height level. When tapping, a shot pressure is supplied to the surface of the molten metal in the reservoir to raise the level of the molten metal in the pouring chamber to a pouring height over an in gate, and thus through a pouring sprue into a mold.

Typically, this kind of pouring furnace is successively fed a plurality of molding flasks just below the down sprue of the pouring furnace, and the shot pressure is supplied into the reservoir at a given timing, thereby pouring out a quantity of molten metal corresponding to the respective mold being filled.

In actuality, however, various molds have different pouring rates and, therefore, to control only the quantity of tapped metal is insufficient from the standpoint of optimum efficiency and automation of the pouring process. Usually, for this reason, after a sprue cup is filled with molten metal, it is required that the molten metal be supplied into the cup so as to keep the level of the metal constant. Thus, a pouring pattern employed by the present assignee herein may consists of a shot pressure, and a period of time during which the shot pressure is applied, each being selected according to the particular kind of mold. According to this kind of pouring pattern, a shot pressure $\Delta p_1$ is applied during an initial period $t_1$, and then a lower shot pressure $\Delta p_2$ is applied during a subsequent period $t_2$.

According to one process presently used by the assignee herein, the aforementioned pouring pattern is set manually. Hence, when molds, which are a few in number but various in kind, are supplied with molten metal from a single pouring furnace, a corresponding variety of pouring patterns must be set frequently, thus lowering operating efficiency and impeding the automation of the process.

SUMMARY OF THE INVENTION

Accordingly, it is an object of the present invention to overcome these difficulties by providing a control apparatus for an automatic pouring furnace in which pouring patterns are read out from a memory and automatically set to allow the use of molds which are limited in number but various in kind.

In accordance with the invention, a control apparatus, such as a microcomputer, for applying control signals to the pressure control valve in the air pressure control system of the automatic pouring furnace is provided. The control apparatus comprises a central processing unit ("CPU"); a read only memory ("ROM") which stores control programs; a random access memory ("RAM") which stores data for controls and data necessary to the pouring patterns described hereinafter; a display device, I/O (input/output) units, and an analog-to-digital converter for converting the output analog signal from a weight detector, which acts to detect the quantity of molten metal within the reservoir, into a digital signal.

When a pouring pattern selecting switch is in a first position, a first pouring pattern is selected; when it is in a second position, a second pouring pattern is selected. If the pouring pattern selection switch is in an EXT position, either the first or second pouring pattern is selected automatically according to a signal from an external line. A setting/automatic changeover switch is provided which can be moved from one position, for setting the desired values of pressure and time, to a second position for operating the device. These signals are applied to the I/O units. Thus, a plurality of pouring patterns are stored in the memory means, and appropriate pouring patterns are automatically read out according to a particular mold to effect a pouring operation in accordance with the stored pouring patterns. The present invention, therefore, is an effective arrangement for increasing efficiency in selecting optimal pouring patterns when various molds are used for a series of casting operations.

BRIEF DESCRIPTION OF THE DRAWINGS

The invention will be better understood by reference to the following detailed description of the attached drawings, in which.

DESCRIPTION OF EXEMPLARY EMBODIMENT

One example of the present invention is described hereinafter with reference to the drawings, it being noted that the automatic pouring furnace in this example is similar to the furnace shown in FIG. 1.

Figure 1:
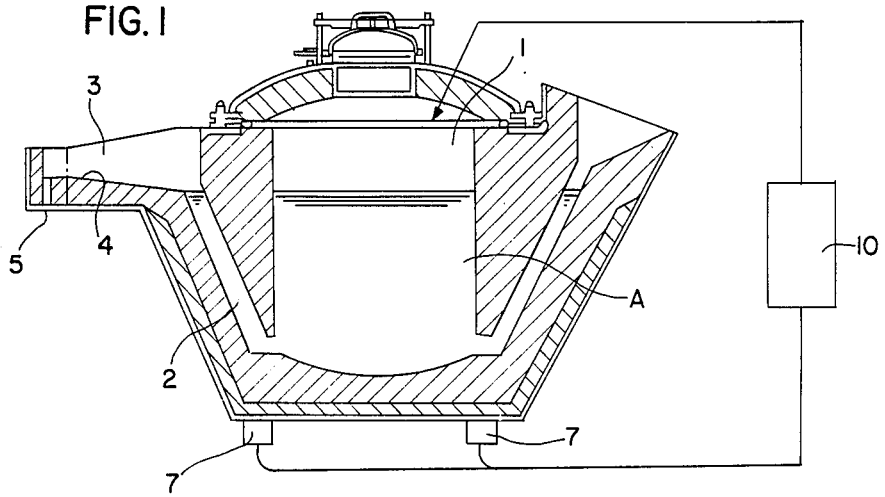
FIG. 1 is a cross-sectional view of an automatic pouring furnace of the type to which the present invention is applicable.

In the automatic pouring furnace shown in FIG. 1, metal or other material is melted by means of induction heating, and air of a predetermined pressure is supplied into a reservoir 1 for the molten metal A to urge the molten metal A into a pouring chamber 3 through a throat 2, while keeping the molten metal A in the reservoir 1. The molten metal that ultimately goes over an in gate 4 is poured out from a down sprue 5.

Figure 2A:
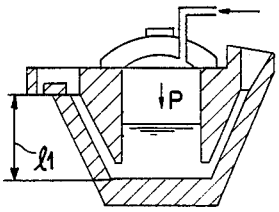
FIGS. 2(*a*) and 2(*b*) illustrate the manner in which a pouring operation is executed.
Figure 2B:
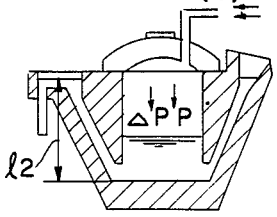
Figure 3:
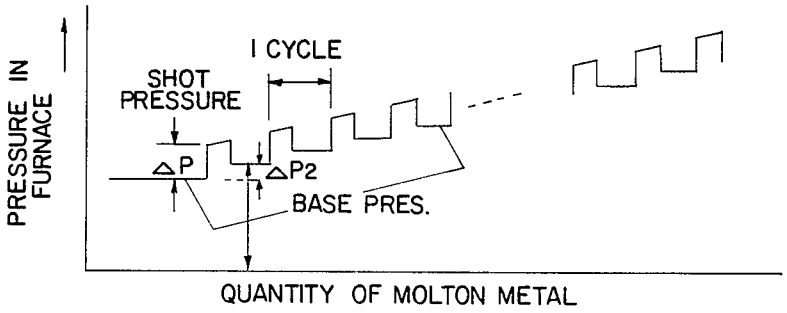
FIG. 3 is a graph showing variations of the base pressures within the pouring furnace of FIG. 1 versus a quantity of molten metal.
Figure 4:
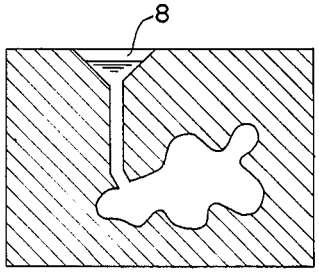
FIG. 4 is a cross-sectional view of one example of a mold.

Referring first to FIG. 2(*a*), tapping has been done in the past by supplying a base pressure p into the reservoir 1, to urge the level of the molten metal within the chamber 3 up to a preset level $l_1$ which is slightly lower than the in gate 4. In order to keep the level of the molten metal within the chamber at the preset level, the base pressure is controlled according to the output from a weight detector 7, the output being indicative of the quantity of the molten metal within the furnace body. The base pressure gradually increases as the quantity of the molten metal decreases, as shown in FIG. 3. Upon tapping, as shown in FIG. 2(*b*), a shot pressure $\Delta p$ is applied into the reservoir to urge the level of the molten metal within the chamber 3 up to a pouring level $l_2$, so that it goes over the in gate 4 and is tapped through the lower sprue 5. As shown in FIG. 3, the initial shot pressure $\Delta p_1$ is maintained for a period of time $t_1$, and then reduced to a lower pressure $\Delta p_2$ for the remainder of the pouring period $t_2$. In FIG. 1, indicated by numeral 10 is a control system.

Figure 7:
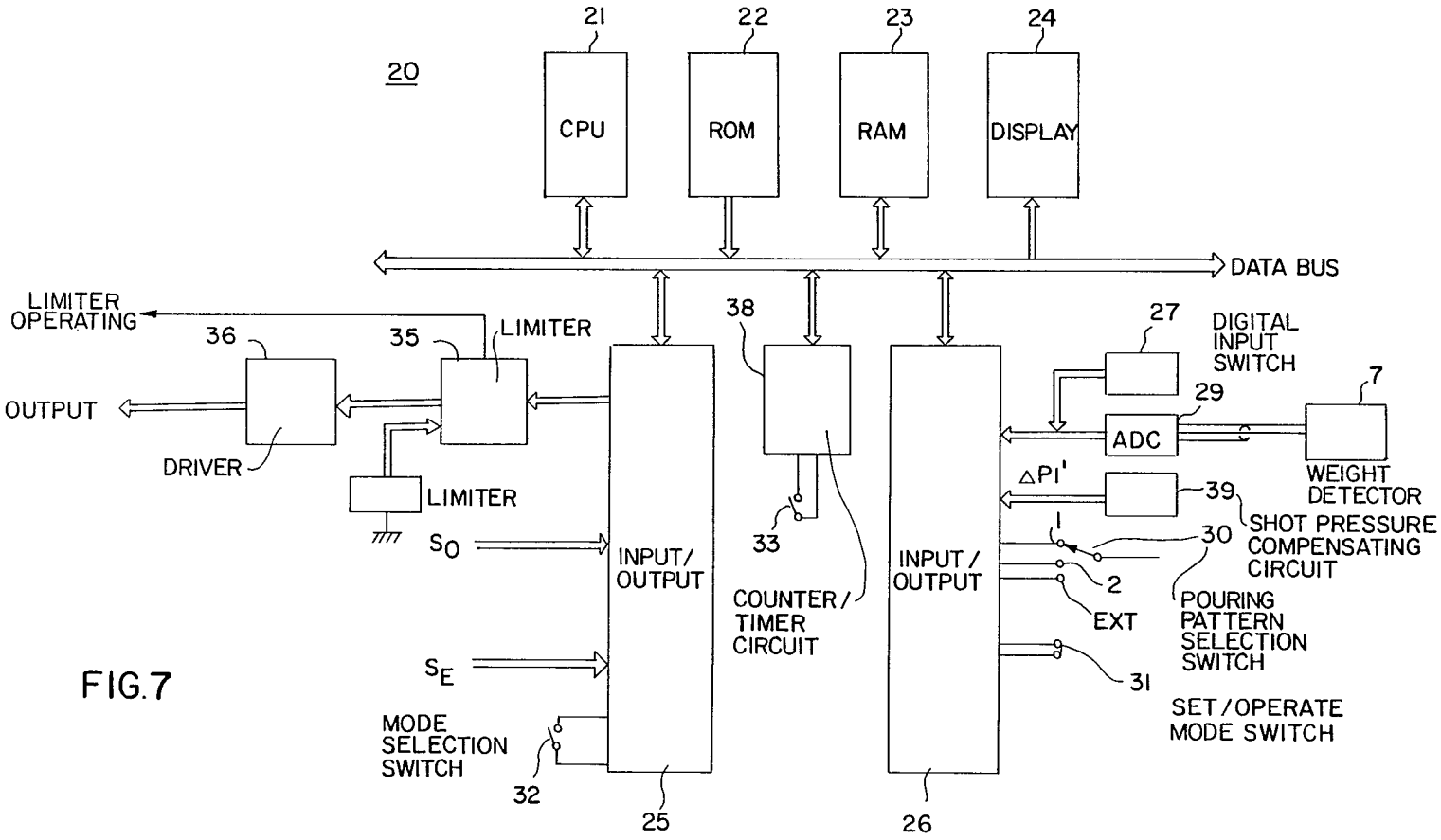
FIG. 7 is a block diagram of a control apparatus used in an automatic pouring furnace according to the present invention.

Referring now to FIG. 7, there is shown a control apparatus 20, such as a microcomputer, for applying control signals to the pressure control valve in the air pressure control system 10 of the automatic pouring furnace. The apparatus includes a central processing unit 21 ("CPU"); a read only memory 22 ("ROM") which stores control programs; a random access memory 23 ("RAM") which stores data for controls and data necessary to the pouring patterns described hereinafter; a display device 24; I/O units 25 and 26; and an analog-to-digital converter 29 for converting the output analog signal from the weight detector 7 into a digital signal. The detector 7 acts to detect the quantity of molten metal within the reservoir 1.

When a pouring pattern selecting switch 30 is in the "1" position, pouring pattern 1 is selected; when it is in the "2" position, pouring pattern 2 is selected; and when it is in the EXT position, either pouring pattern 1 or 2 is selected automatically according to a signal SO from an external line. A setting/automatic changeover switch 31 may be moved between a first position, for setting the pressure and time values for each pattern, and a second position for operating the pouring furnance in accordance with those set patterns. These signals are applied to the I/O unit 26.

Figure 8:
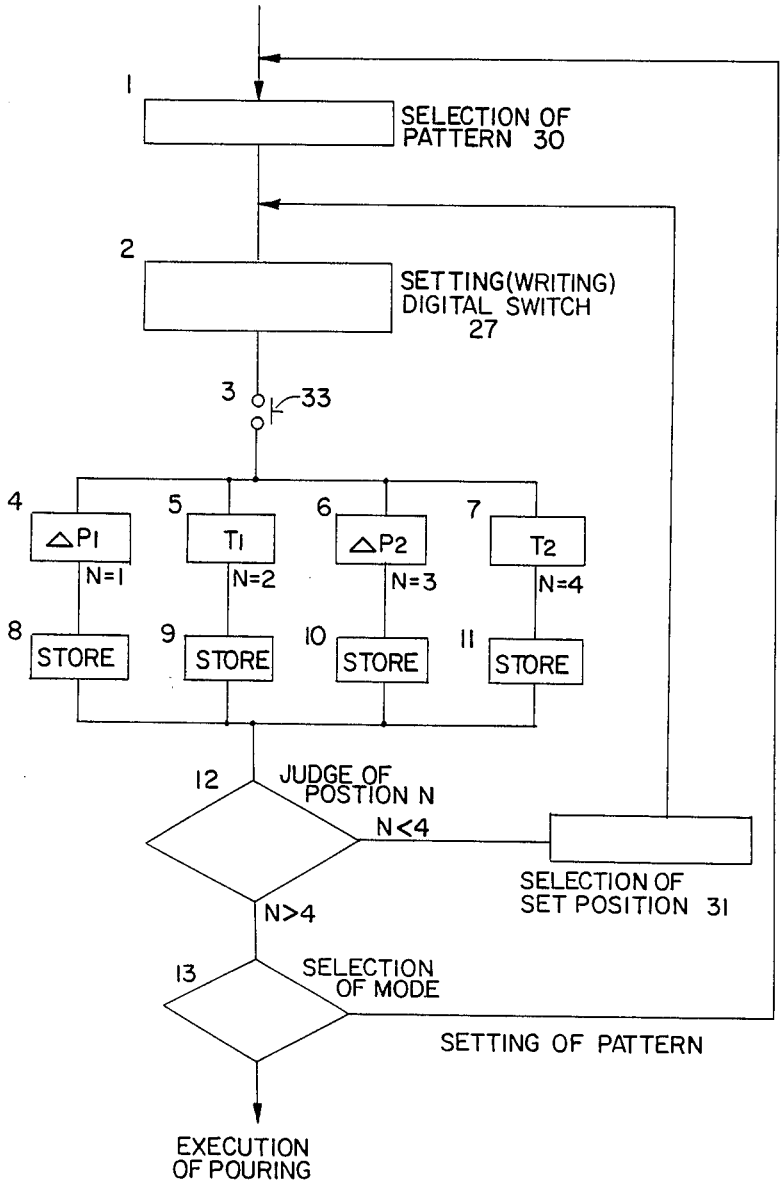
FIG. 8 is a flowchart illustrating one example of the manner in which pouring patterns are entered into memory by the control apparatus illustrated in FIG. 7.

The following describes the sequence, shown in FIG. 8, of loading the pressure and time values into the RAM 23. The RAM 23 has a storage block for storing shot pressure $\Delta p_{11}$ and period $t_{11}$, and shot pressure $\Delta p_{12}$ and period $t_{12}$, in pouring pattern 1, and another storage block for storing shot pressure $\Delta p_{21}$ and period $t_{12}$ and shot pressure $\Delta p_{22}$ and period $t_{22}$ in pouring pattern 2 (see FIGS. 8 and 10).

Figure 9:
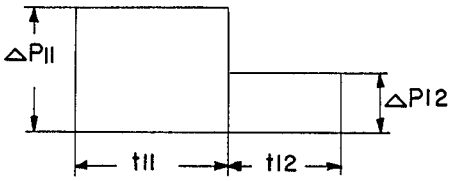
FIG. 9 is a graph showing yet another example of a pouring pattern.

Prior to operating the pouring furnace, the switch 31 is placed in its "setting" position and the switch 30 is placed in the "1" position in order to input information regarding pouring pattern 1. A shot pressure, for example $\Delta p_{11}$ in pouring pattern 1, as shown in FIG. 9, is selected and entered by the digital switch 27. The selected value of $\Delta p$ will be displayed on the display device 24. Once $\Delta p$ has been entered by unit 27, a writing switch 33 is activated, setting counter 38 to "1". As a result, step 4 shown in FIG. 8 is selected, and the set value $\Delta p_{11}$ is stored in the storage block of RAM 23 (step 8) corresponding to pouring pattern 1.

Next, the program proceeds to step 12, where the content value N of the counter is judged to determine whether it is less than 4. If less than 4, and the switch 31 remains in the "setting" position, the flow returns to step 2. Thereafter, a time period $t_{11}$ is set by the digital switch 27 and the writing switch 33 is actuated, whereupon the counter 38 has value "2". Then, steps 5 and 9 (FIG. 8) are selected and period $t_{11}$ is stored in the storage block of RAM 23. Similarly, shot pressure $\Delta p_{12}$ and period $t_{12}$ in pouring pattern 1 are stored in the storage block of RAM 23. At such time, the counter 38 has reached the value 4, whereupon the flow will proceed to step 13, and the mode is judged to determine whether switch 31 is in a setting mode or an execution mode. If it is in a setting mode, the flow will return to step 2.

Figure 10:
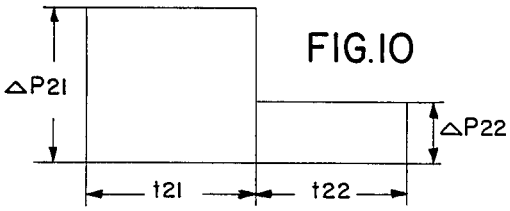
FIG. 10 is a graph similar to FIG. 9 showing another pouring pattern.

Then, in order input information regarding pouring pattern 2, the selecting switch 30 is placed in "2" position, and data, such as shot pressure $\Delta p_{21}$, period $t_{21}$ and shot pressure $\Delta p_{22}$, period $t_{22}$ in pouring pattern 2 as shown in FIG. 10, are written into the storage block in the same manner as in the foregoing with respect to pouring pattern 1. When the programing of the pouring patterns has been thus completed, switch 31 is switched out of the "setting" position into a "run" position.

In the operation of the pouring furnace, the selecting switch 30 may be placed in the EXT position. When signal SO is applied from a mold feeder to the I/O unit 25, indicating that mold A to be fed next needs pouring pattern 1, pouring pattern 1 is selected in the CPU 21; base pressure p, shot pressure $\Delta p_{11}$ and $\Delta p_{12}$ and periods of time $t_{11}$ and $t_{12}$ are read out by the CPU. Signals from the CPU 21 are fed to a driver 36, through a limiter 35, for causing the driver 36 to actuate a pressure control valve (not shown) of the air control system. Thus, air is supplied into the reservoir 1 in the pattern of shot pressure $\Delta p_{11}$, period $t_{11}$ and $\Delta p_{12}$, $t_{12}$ as shown in FIG. 9, whereby molten metal is supplied in a manner appropriate to the mold A.

When signal SO', indicating that the following mold B needs pattern 2, is applied to the I/O port 25, the CPU 21 selects pattern 2, whereupon shot pressure $\Delta p_{21}$, period $t_{21}$ and $\Delta p_{22}$, $t_{22}$ in the pouring pattern 2 are read out from the storage block of RAM 23, and the valve of the air control system is controlled in the same manner as in the above process. Accordingly, as shown in FIG. 10, shot pressure $\Delta p_{21}$ is applied into the reservoir 1 during the time period $t_{21}$, and then shot pressure $\Delta p_{22}$ is applied into it during the period $t_{22}$, thereby allowing a predetermined quantity of pouring.

If the selecting switch 30 is placed in a position of pattern 1, data on pouring pattern 1 are read out to effect a pouring in pattern 1, irrespective of the value of the signal SO. Also, if the switch 30 is placed in a position of pattern 2, data on pattern 2 are read out to effect a pouring in pattern 2.

Figure 5:
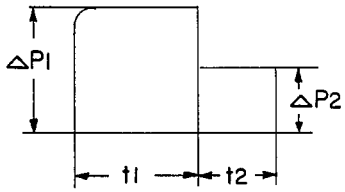
FIG. 5 is a graph showing one example of a pouring pattern.
Figure 6:
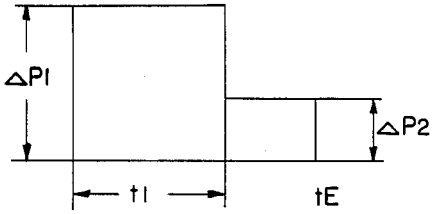
FIG. 6 is a graph similar to FIG. 5 showing another pouring pattern.

In the operation described above, the cycle time of each pouring pattern is fixed by the pre-selected values $t_1$, $t_2$. It may be desirable, however, while using the same pouring pattern of $\Delta p_1$, $t_1$, $\Delta p_2$, for a specified type of mold, to regulate the pouring time $t_2$, during which the reduced shot pressure is applied, by an outside signal. For this purpose, a mode selecting switch 32 is provided. Either mode 1 or mode 2 is selected by a mode selecting switch 32. With reference to FIG. 5, in mode 1, periods of time $t_1$ and $t_2$, during which shot pressures $\Delta p_1$ and $\Delta p_2$ are applied, respectively, are set by a timer or the like in accordance with the values entered by digital switch 27. On the other hand, as illustrated in FIG. 6, in mode 2 the period of time during which $\Delta p_2$ is applied is not set, but the termination $t_E$ of the application of shot pressure $\Delta p_2$ is controlled by an external signal SE, for example, from a means for detecting the quantity of tapped metal. Thus, by selecting mode 1 or 2, the length of the filling operation during the period of reduced shot pressure may either be predetermined (mode 1) or regulated by an external signal (mode 2).

If mode 2 is set by the mode setting switch 32 and when pattern 1 is selected, for example, air of shot pressure $\Delta p_{11}$ is supplied into the reservoir 1 during period $t_{11}$, and thereafter shot pressure $\Delta p_{12}$ is applied into it until a signal, indicating that a predetermined quantity of molten metal has been supplied into a mold, is received.

When the temperature of the pouring furnace itself is relatively low, as experienced at the beginning of use of the furnace, a shot pressure compensating circuit 39 may produce an instruction signal for generating a pressure $\Delta p_1'$ to be added to shot pressure $\Delta p_1$.

Prior to a filling operation, switch 31 is set to the "setting" position, which causes the CPU 21 to execute a program in accordance with FIG. 8. After the values of pressure and temperature have been read in and stored in RAM 23, the CPU executes the pouring operation.

A weight value from weight defector 7 is converted from analog into digital form by unit 29, and fed to CPU 21, which issues a signal, through driver 36, to set the base pressure "P" for raising the level of molten metal to an appropriate pre-set level, such as shown in FIG. 2(*a*). The value SO is read to determine the pouring pattern "1" or "2".

Assuming pouring pattern "1" is selected for the particular mold to be filled, the CPU 21 issues signals through driver 36 to cause pressure increase $P_{11}$ to be delivered to reservoir 1 for a period $t_{11}$. Thereafter, CPU 21 issues a signal through driver 36 to reduce the pressure increase to $P_{12}$ either for a period $t_{12}$ (if switch 32 is in mode 1) or for a period $t_E$ (if switch 32 is in mode 2). Operation for pouring pattern 2 is similar.

Figure 11:
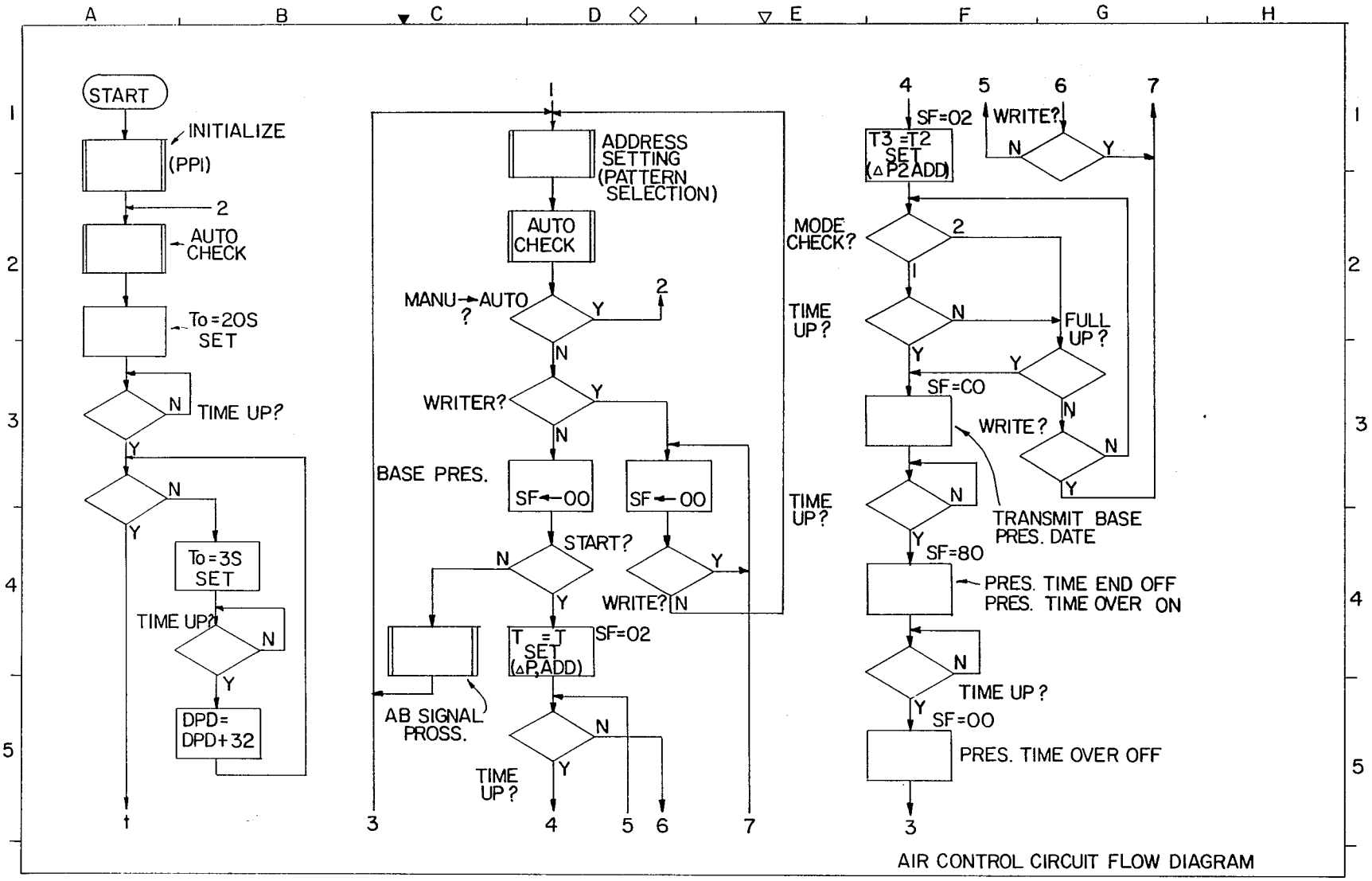
FIG. 11 is an air control circuit flow diagram for the pouring operation.

FIG. 11 illustrates a flow diagram of an exemplary embodiment of a control program, for control apparatus 20, to execute a pouring operation. Referring to FIG. 7, by way of example the following components may be employed in the control apparatus: CPU 21 may be a Mostech Z-80 (LH0080); I/O unit 25 a Mostech Z-80PIO; counter/timer circuit (CTC) 38 a Sharp Z-80CTC (LH0082); RAM 23 a Toshiba TC-5516; PPI 26 a NEC D 8255AC-5; and ROM 22 a Mitsubishi-2716.

As described in detail hereinbefore, in accordance with the present invention a novel arrangement for supplying a shot pressure into the reservoir to tap molten metal for incremental supply into molds is provided. A plurality of pouring patterns are stored in a memory means, and appropriate pouring patterns are automatically read out according to a particular mold to effect a pouring operation in accordance with the stored pouring patterns. Thus, the present invention is effective for increasing efficiency in selecting optimal pouring patterns when various molds are used for a series of casting operations.

It will be appreciated by those skilled in the art that variations and modifications may be made without departing from the spirit of the present invention. For example, it would be appreciated by one skilled in the art that more than two pouring patterns may be stored. All such variations and modifications are intended to fall within the scope of the appended claims.

I claim:

1. In an automatic pouring furnace having a reservoir for molten metal, a throat, a pouring chamber communicating with the reservoir through said throat, a down sprue communicating with said pouring chamber, means for applying air of a predetermined base pressure to the molten metal with the pouring chamber to urge the molten metal up to a present level while causing the reservoir to keep the metal in store, said means for applying air being adapted to apply an additional shot pressure into the reservoir to tap a predetermined quantity of the molten metal through the down sprue, the improvement comprising a memory means for storing information representative of at least one pouring pattern, comprising a first additional shot pressure and an associated period of time during which the first additional shot pressure is applied, and a second additional shot pressure and associated period of time during which the second additional shot pressure is applied, said second additional shot pressure being different from said first additional shot pressure, whereby a pouring pattern corresponding to a mold is read out of said memory means to effect a pouring operation in two stages.

2. The automatic pouring furnace according to claim 1 wherein the memory means stores information representative of plurality of pouring patterns, wherein each pouring pattern comprises at least two shot pressures and corresponding periods of time during which the shot pressures are applied.

3. The automatic pouring furnace according to claim 2 further including means for detecting the quantity of the molten metal in said mold and switch means for enabling selection of an external-signal operating mode, and wherein at least one of the periods of time corresponding to a shot pressure is controlled by an external signal corresponding to the quantity of molten metal in the mold when the switch means is in the external signal operating mode position.

4. The automatic pouring furnace according to claim 1 wherein the second additional shot pressure is less than the first additional shot pressure.

5. In an automatic pouring furnace having a reservoir for molten metal, a throat, a pouring chamber communicating with the reservoir through said throat, a down sprue communicating with said pouring chamber, means for applying air of a predetermined base pressure to the molten metal within the pouting chamber to urge the molten metal up to a preset level while causing the reservoir to keep the metal in store, said means for applying air being adapted to apply an additional shot pressure into the reservoir to tap a predetermined quantity of the molten metal through the down sprue, the improvement comprising:

memory means for storing information representative of a plurality of pouring patterns each corresponding to a respective one of various molds, wherein each of said pouring patterns comprises first and second additional shot pressures and the respective periods of time during which the additional shot pressures are applied, and wherein the first and second additional shot pressures are different;

switch means for enabling selection of one of said pouring patterns;

control means responsive to said switch means for addressing the information stored in the memory means for the pouring pattern selected and for controlling the means for supplying air pressure to apply the shot pressures for the respective time periods as represented by the information stored and addressed in memory.

6. The automatic pouring furnace according to claim 5 further including means for detecting the quantity of the molten metal in said mold and second switch means for enabling selection of an external signal operating mode, and wherein the control means controls the time period during which at least one shot pressure is generated in response to the quantity of the molten metal when the second switch means is in the external signal operating mode position.

7. The automatic pouring furnace according to claim 5, further including shot pressure compensating circuit means for producing a compensation signal in response to a condition indicating that the furnace is relatively cold, and wherein the control means increases the amount of shot pressure applied in response to said compensation signal.

8. The automatic pouring furnace according to claim 5 further inluding a setting/operation mode switch means and data input switch means, and wherein the control means includes means for receiving data inputed by said data input switch means representative of at least one shot pressure and time period for one pouring pattern and for writing information representative of said data into the memory means when said setting-/operation mode switch is in a setting position.

9. The automatic pouring furnace according to claim 8 further including display means for generating a display of the data inputted by said data input switch means.

* * * * *